United States Patent [19]

Peterson et al.

[11] Patent Number: 4,726,277

[45] Date of Patent: Feb. 23, 1988

[54] ELECTRICAL STOP CONTROL FOR MUSICAL INSTRUMENTS

[76] Inventors: Richard H. Peterson, 11601 S. Mayfield Ave., Worth, Ill. 60482; Justin Kramer, 1028 W. 8th Pl., Los Angeles, Calif. 90017

[21] Appl. No.: 915,350

[22] Filed: Oct. 6, 1986

[51] Int. Cl.[4] ..... G10B 3/10

[52] U.S. Cl. ..... 84/343; 84/369; 335/164

[58] Field of Search ..... 84/337-345, 84/369-371; 335/151-153, 164, 186

[56] References Cited

U.S. PATENT DOCUMENTS 4,615,254 10/1986 Klann ..... 84/343

*Primary Examiner*—S. J. Witkowski

*Attorney, Agent, or Firm*—Jones, Tullar & Cooper

[57] ABSTRACT

Electrically and manually operable stop controls for a musical instrument such as an organ are disclosed. One embodiment of the stop control is a drawknob carried by an a transfer plate mounted for horizontal motion adjacent a solenoid having an iron core. Vertical hinge members at opposite ends of the solenoid support the transfer plate. A permanent magnet is mounted on each hinge member in general alignment with the iron core, the hinge members being spaced apart sufficiently to insure that only one permanent magnet at a time is adjacent the iron core, to thereby provide a manual magnetic and gravity-operated toggle motion. Application of an electrical direct current of selected polarity to the solenoid permits electrical shifting of the transfer plate. In a further embodiment, the drawknob is secured to a pivotally mounted armature having a cross-member which carries permanent magnets. Solenoids are mounted at opposite ends of the cross-member to provide electrical shifting of the armature. Fixed permanent magnets adjacent the path of the cross-member provide a toggle action. Another embodiment includes a stop control tablet secured to a pivotally mounted armature having a cross-member spanning a pair of control solenoids.

23 Claims, 10 Drawing Figures

FIG. 3
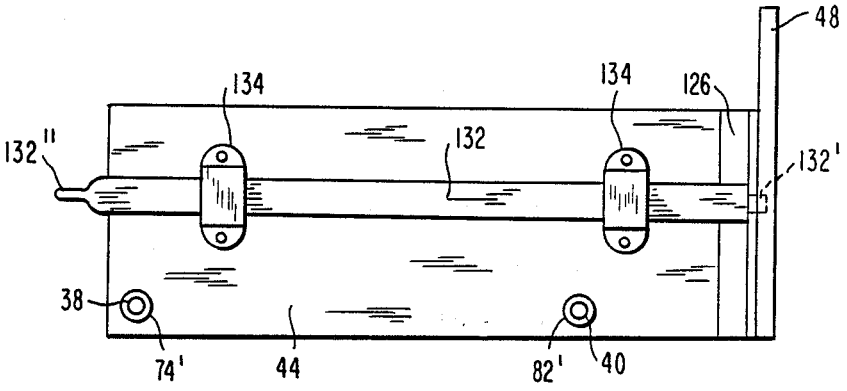
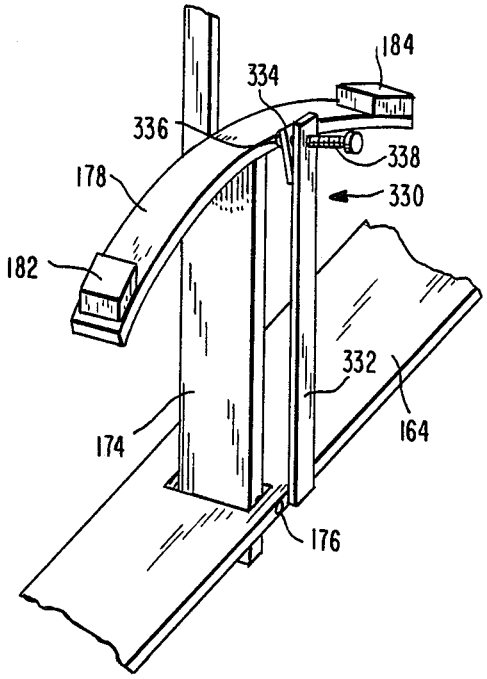
FIG. 10

FIG. 8
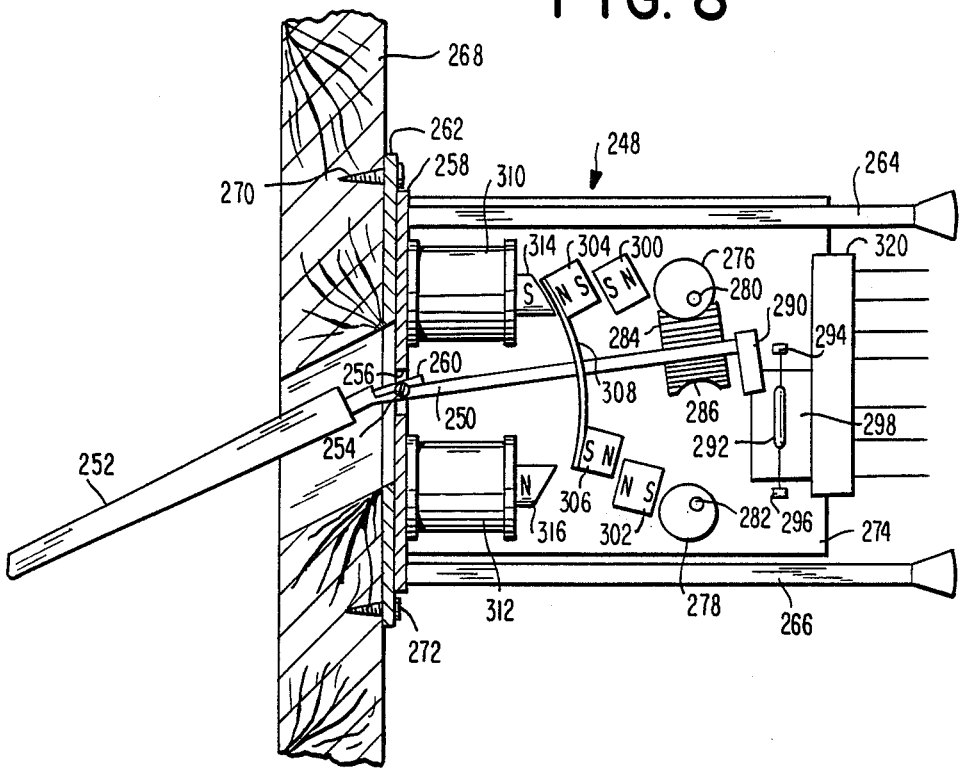
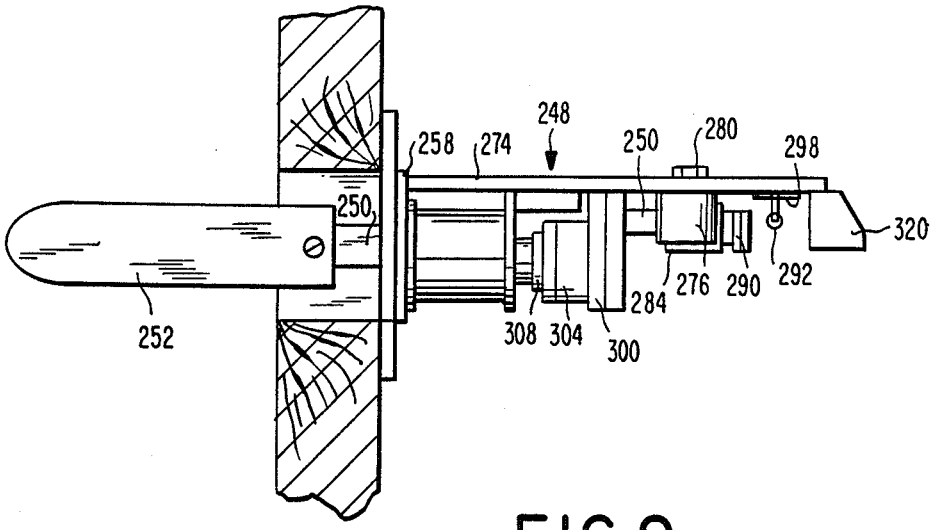
FIG. 9

ELECTRICAL STOP CONTROL FOR MUSICAL INSTRUMENTS

BACKGROUND OF THE INVENTION

The present invention relates, in general, to pipe organs, electronic organs, and associated musical instruments. In particular, it relates to that portion of these instruments commonly called "stops" or "stop controls", which are used by the organist or player to select the desired musical tone colors. These controls are mechanical switches which are sometimes referred to as drawknobs, tilting tablets, or the like.

In the course of playing music on instruments such as pipe or electronic organs, the player operates the various stops or stop controls in various combinations and at selected times to produce the variety of musical tones which such instruments are capable of providing. It is sometimes necessary or desirable for the player to operate numerous individual stop controls at one time, and for this reason it is common practice in the design and construction of organs to provide the player with at least one separate control, and usually several controls, which will permit the player to change the position of several stop controls all at the same time by pressing a single button, which is commonly called a "combination piston". Most organs have numerous combination pistons which provide the player with the ability to operate selected groups of stop controls at will by having each selected group or combination of stops assigned to a single corresponding combination piston. Such an arrangement requires that each stop control must be able to be operated either manually to permit individual stop controls to be actuated by the player, or electro-mechanically, so that the individual stop controls can be operated in combinations as a result of the player activating a combination piston.

To those familiar with the art, it is well known that noise is a problem when electro-mechanical switches are operated, and such noise is especially undesirable in musical instruments such as organs. Ordinarily, the source of such noise is the various linkages that are required to convert the motion of the drawknobs, tilting tablets, and the like devices to produce switch operation, and the noise is principally the result of the movement of such linkages by means of an electric solenoid, which tends to move the linkages suddenly and rapidly, and such noise is accentuated by the mass of the moving parts.

Another problem in the design of electrically operated stop controls has been the provision of a movement that will provide the organist with a switch that will have a positive "feel" in the movement from an on position to an off position, or vice versa. Such a feel is ordinarily described as a "toggle feel" and enables the player to know that the switch has moved in a positive manner from one position to another. Providing a toggle feel to the drawknob of a stop control has, in the past, required that the moving part of the switch have substantial mass so as to provide inertia for the manual operation. However, this same mass produces problems in the electrically operated mode, since it requires that substantial power be applied through the electric solenoid in order to move the massive switch components.

A typical organ console utilizes a large number of stop controls, so if each control requires a large amount of power for operation, then massive power supplies become necessary, together with heavy cables for carrying the current required to operate large numbers of stop controls simultaneously. This creates an inefficient system, and increases the potential for noise. The efficiency of such systems is further reduced by the friction which is a result of the rubbing together of the various parts of the switch, particularly the movement of an armature core through a solenoid coil in a typical solenoid configuration. Such solenoids are often further affected by corrosion or the accumulation of dirt or dust within the solenoid so that the motion of the switch is often delayed or prevented altogether unless great care is taken to provide frequent, regular maintenance.

Attempts have been made to produce stop controls having lower power requirements by making them of lighter-weight materials. This has resulted in flimsy assemblies having excessive side play or in which the drawknob can rotate.

In addition to the foregoing problems are the difficulties associated with the installation of electro-mechanically operated stop controls in the limited space provided on the drawknob panel, or stop jamb, of an organ. Such jambs may be limited in size in smaller organs, or may be crowded with a multitude of stop controls in larger instruments. Thus, the space limitations inherent in organ consoles have made it difficult to install or service electro-mechanically operated stop controls.

It has been proposed to overcome the foregoing difficulties through the use of magnetic toggle arrangements, wherein a pair of permanent magnets are provided, one mounted on a movable drawknob and the other mounted on a stationary frame adjacent the path of the drawknob so as to repel the first magnet. The repulsion of like poles of the magnets provides a toggle feel to the movement of the drawknob, while allowing the device to be made small enough to fit into an organ console. It has also been provided to operate such devices by means of solenoids driven by electrical pulses produced by small pulse sources in order to avoid the need for large power supplies and connector cables.

However, it has been found that when such permanent magnet devices are driven by pulsed power supplies, problems arise, for the permanent magnets tend to magnetize the pole pieces and movable armatures in the device. When this occurs, the applied pulses must first overcome this magnetization before the desired toggle operation can occur, thereby making the operation of the device nonlinear. Such nonlinearity adversely affects the tolerances of the device, requiring larger pulses than would otherwise be required, and placing restrictions on the location of the permanent magnets, the location of motion-limiting blocks, and the like. This makes it difficult to manufacture such control stops reliably, and counters many of the efficiencies that would otherwise have been provided by the magnetic-repulsion concept.

SUMMARY OF THE INVENTION

It is, therefore, among the objects of the present invention to provide a new and improved electrically actuated stop control which will not produce noise when switched between its off and on positions.

Another object of the invention is to provide an electrically actuated stop control which, when manually operated, will have a toggle feel and will produce the illusion of having substantial mass, but without actually having the mass ordinarily associated with such a toggle feel.

Still another object of the invention is to provide a highly efficient stop control mechanism which obtains its efficiency through the elimination of mass and friction, thereby reducing the electric power requirements of musical instruments such as pipe organs, electronic organs and the like.

A further object of the invention is to provide a stop control mechanism which is sturdy in construction, which does not have a noticeable side play, and which will not rotate.

Still another object of the invention is to provide an electrically operated stop control utilizing an electric actuator which is sufficiently small to permit installation in organ consoles having very limited space.

Still another object of the invention is to provide a stop control construction which will be easy to install or to remove from an organ console.

Briefly, the present invention is directed, in one embodiment, to a unitary stop control assembly having a movable drawknob attached to a horizontally movable carrier mechanism which includes a transfer plate carried by spaced vertical hinge members pivotally mounted at their lower ends between a pair of spaced, rigid, vertical mounting plates forming a housing frame for the device. These mounting plates may be securely fastened to the stop jamb of an organ or similar musical instrument. Preferably, the mounting plates are removably mounted on the back surface of an organ stop jamb by means of L-shaped mounting brackets located on one end of the plates. These brackets are secured to the jamb by means of threaded fasteners having shanks which extend the full length of the stop control assembly. The fasteners are easily accessible from the rear of the assembly, while the threaded forward end of each fastener extends through its corresponding bracket and allows connection of the stop control to an organ console even where access is limited. The vertical hinge members support the transfer plate between the mounting plates in such a way that the transfer plate is free to move horizontally toward and away from the console stop jamb upon inward and outward motion of the drawknob.

Mounted between the vertical plates and located between the spaced hinge members is an electrical solenoid having an iron core. A permanent magnet is attached to each of the two hinge members, with the hinge members being spaced sufficiently far apart from their connection to the transfer plate that only one of the permanent magnets can be adjacent the iron core at a time. As the transfer plate moves horizontally, the hinge members pivot to carry one or the other of the magnets toward the iron core, and to carry the other magnet away from the core. As one magnet moves toward the core, it becomes more strongly attracted thereto; at the same time, the other magnet moves away and becomes more weakly attracted. This causes the transfer plate to tend toward one extreme of its motion or the other as the horizontal motion of the transfer plate on the hinges brings one or the other of the permanent magnets into a position adjacent a corresponding end of the solenoid iron core. Further, the weight of the transfer plate and of the permanent magnets above the pivotal connection of the hinge members to the housing causes the carrier mechanism, and thus the transfer plate, to fall toward one end or the other of its horizontal path.

The interaction of the magnetic fields of the permanent magnets with the solenoid core, together with the force of gravity on the carrier mechanism, serve to hold the transfer plate in one position or the other, thereby producing a toggle action. By applying sufficient force to the drawknob, the position of the transfer plate can be manually shifted, thereby withdrawing one of the permanent magnets and moving the other into a position adjacent to the solenoid core. Suitable resilient pads and stop blocks, or limit posts, are provided on the carrier mechanism and on the mounting plates to prevent the permanent magnets from striking the ends of the iron core, and to reduce the noise produced by this motion. The interaction of the permanent magnets with the iron core produces a very desirable toggle feel to the motion of the armature when it is moved by an operator by means of the drawknob.

In addition, the device is capable of a remote operation by electrically activating the solenoid so that by application of a current of suitable direction and duration, the magnetic field produced by the solenoid will selectively repel or attract the permanent magnets to cause the carrier mechanism to shift in a desired direction. Reversing the current in the solenoid reverses the direction of motion of the mechanism so that remote control of the position of the drawknob can be effected.

The positive "feel" and positioning of the carrier mechanism, and thus of the drawknob, can be enhanced by the provision of a pair of permanent magnets, one on the movable part of the stop control, such as on the transfer plate, and the other mounted in a fixed position on one of the mounting plates in a location adjacent to the path of motion of the first permanent magnet. These magnets are oppositely poled so that they tend to repel each other when the transfer plate is in one of its two rest positions. In addition, a resilient pad may be mounted on one of the mounting plates to abut one or the other of a pair of limit posts, or blocks, mounted on the transfer plate. These posts are positioned to stop the motion of the transfer plate by engaging the resilient pads before the permanent magnets mounted on the hinge members can contact the solenoid core.

In a second embodiment of the invention, the carrier mechanism includes one hinge member connected between the stationary housing and a first end of the movable transfer plate, and a second hinge member connected only to the housing. The second end of this latter hinge member slidably extends through an aperture in the second end of the transfer plate, near the stop jamb, and provides horizontally directed forces to the transfer plate, but no vertical support. This second end of the transfer plate is supported by the drawknob where it passes through the stop jamb.

In another embodiment of the invention, the unitary stop control assembly includes a drawknob which is mounted on a horizontally movable L-shaped transfer plate. An elongated armature is pivotally secured at its first, or near, end to a frame assembly and is pivotally connected at its second, or far, end to the transfer plate. The frame assembly is attachable to the rear surface of the stop jamb of an organ or similar musical instrument, as by means of threaded fasteners having shanks which are easily accessible from the rear of organ console.

Mounted on the frame assembly, on opposite ends of the path travelled by the armature during inward and outward movement of the drawknob, are a pair of electric solenoids having iron cores and surrounding coils which are connectable to a suitable pulsed power source under the control of the organist. Midway between the pivotal connections at its opposite ends, the armature carries an arcuate cross-member having a pair of oppositely extending arms which extend over the ends of corresponding solenoid pole pieces when the armature is centrally located therebetween, and which forms an armature extension. Two permanent magnets are mounted on the cross-member, one on the end of each arm.

A printed circuit board is rigidly mounted on the frame and is parallel to the path of the armature and of the horizontally movable transfer plate which attaches the armature to the drawknob. The circuit board carries two additional permanent magnets, one adjacent the path of each of the first two magnets and generally aligned therewith, to form magnet pairs.

The upper end of the armature, which is connected to the transfer plate, carries a pair of felt bumpers which engage corresponding limit posts mounted on the circuit board at opposite ends of the path traveled by the armature, to limit the armature motion. A fifth magnet is mounted on the drawknob transfer plate to operate a reed switch mounted on the circuit board, whereby motion of the drawknob operates the switch.

The two pairs of permanent magnets mounted on or adjacent the armature provide a toggle operation for the drawknob when it is operated manually, the repulsion effect of the magnets serving to hold the drawknob in either its maximum inward or maximum outward positions. The felt bumpers mounted on the outer end of the armature and the cooperating limit posts prevent rebound, yet provide a quiet operation. The device is lightweight and, with only two pivot points, is relatively friction-free, so it can be operated by pulses applied to the solenoids. The hinged armature arrangement provides a strong assembly which prevents rotation of the drawknob.

The permanent magnets mounted on the armature cross-member serve to magnetize the ends, or tips, of the cross-member if it is of a ferromagnetic material. This "tip polarization" of the cross-member is preferred, and is used to advantage in the configuration of this embodiment, to provide a predictable more sensitive response for solenoid operation of the device, and thereby to overcome the problem of nonlinearity of response encountered in prior stop control devices using a permanent magnet and an electromagnet as a repulsion mode.

Another embodiment of the invention applies the features of the foregoing drawknob structure to a stop control tablet assembly which is also manually and electrically operated. In the tablet assembly, the stop control tablet is secured to the first, or inner, end of an elongated armature which is pivotally mounted at the tablet end to a frame. The frame is securable to the back surface of an organ console jamb, and carries a printed circuit board which is parallel to the pivotal path of the armature. A pair of solenoids are mounted to the frame, one at each end of the path of the armature, as previously described. The armature carries a centrally-located arcuate cross-member which serves as an armature extension, the ends of which extend over the solenoid poles and carry first and second permanent magnets. Third and fourth magnets are mounted on the circuit board adjacent the path of the cross-member to provide magnetic pairs which produce a toggling operation.

The far, or second, end of the armature carries a pair of felt bumpers which abut corresponding limiting posts at the opposite ends of the desired path for the armature. Also mounted on the far end of the armature is a fifth magnet which operates a corresponding reed switch mounted on the circuit board. The operation of this embodiment is similar to that of the second embodiment described above, and provides the same advantages of low friction, low noise, small size, reliability and ease of manufacture.

If desired, adjustable damping means may be provided for the armature or the transfer plate of any of the foregoing embodiments to permit adjustment of the ease of operation of the stop control. This permits the feel of the low-friction, lightweight device of the present invention to be adjusted to provide a slightly heavier feel, if desired.

The stop control of the present invention is a smooth-operating drawknob or tablet which provides a firm toggle feel to the operator, while at the same time being easy to move. The device has no metal-to-metal sliding parts and therefore is virtually immune to the problems of corrosion and accumulation of dirt and dust experienced with prior drawknob and tablet devices. In addition, the device is electrically operable so that it can be remotely controlled either alone or in combination with other similar drawknobs or tablets. Further, the device is compact and can easily be installed in the limited space of an organ console.

BRIEF DESCRIPTION OF THE DRAWINGS

The foregoing and additional objects, features and advantages of the present invention will become apparent to those of skill in the art upon consideration of the following detailed description of a preferred embodiment thereof, taken in conjunction with the accompanying drawings, in which:

FIG. 3 is a partial side elevation of the stop control of FIG. 1;

FIG. 8 is a side elevation of a fourth embodiment of the invention, showing a stop control tablet;

FIG. 9 is a top plan view of the embodiment of FIG. 8; and

FIG. 10 is a perspective view of an adjustable damper for the stop control.

DESCRIPTION OF PREFERRED EMBODIMENTS

Figure 1:
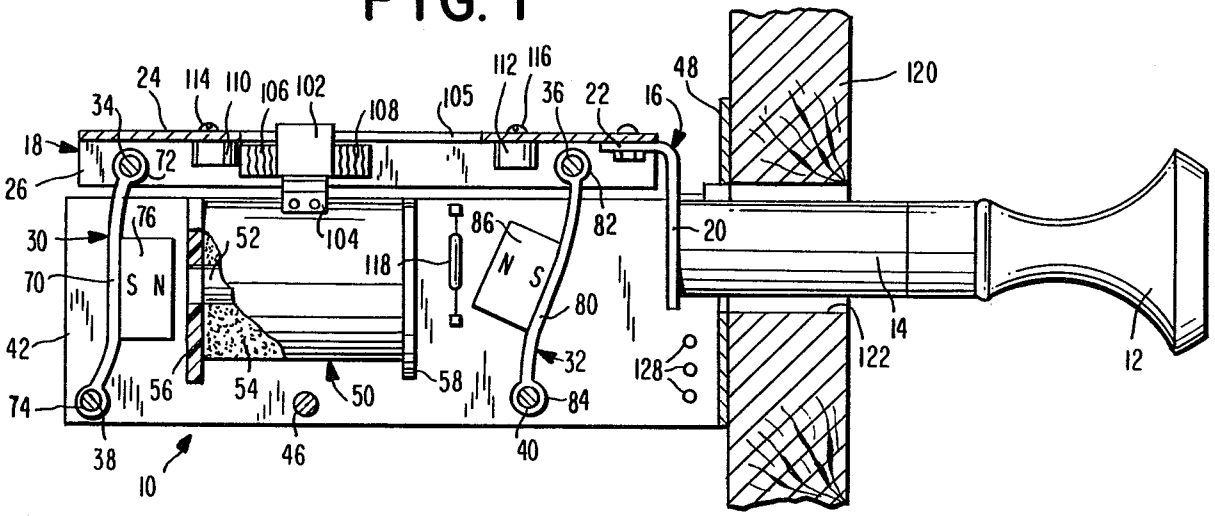
FIG. 1 is a cross-sectional view of a stop control device constructed in accordance with the present invention, taken along line 1—1 of FIG. 2.
Figure 2:
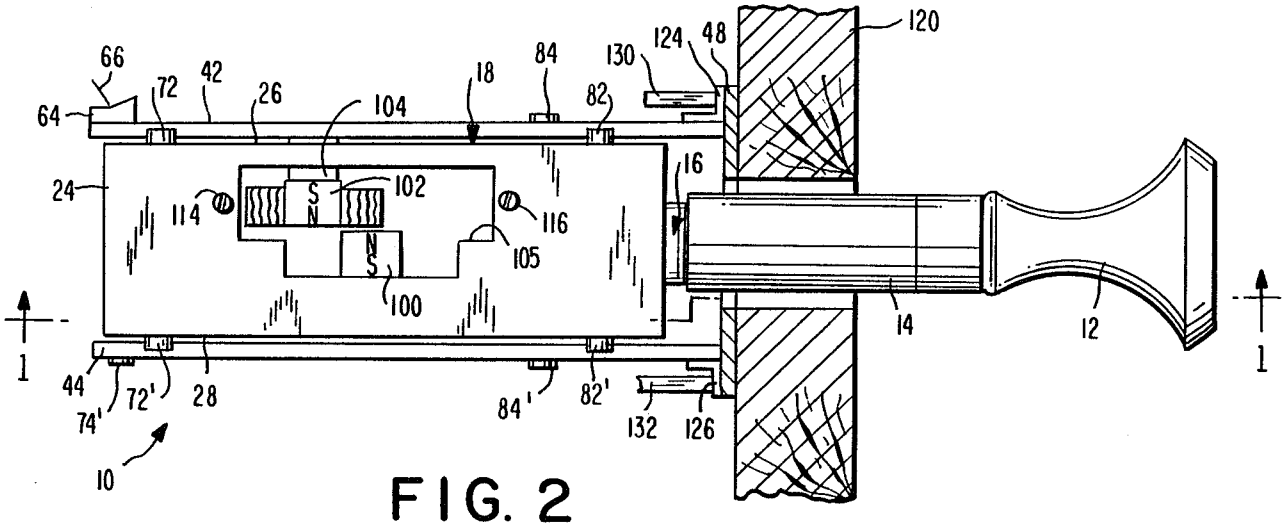
FIG. 2 is a top view, partially cut away, of the device of FIG. 1.

Referring now to FIGS. 1 and 2, there is illustrated generally at 10 a stop control drawknob device which is utilized in a musical instrument such as a pipe organ or electronic organ to select desired musical tone colors. The stop control device includes a drawknob 12 connected by way of a shaft 14 and an angle bracket 16 to a movable carrier assembly 18. The angle bracket 16 is L-shaped and includes a lower leg portion 20 which is fastened to the end of shaft 14 opposite to drawknob 12, while an upper leg 22 portion is fastened to the carrier assembly 18. The drawknob is shown as being in the "on" position, where the knob is pulled out, away from a stop jamb.

Carrier assembly 18 includes a generally horizontal, transfer plate 24 having downturned flanges 26 and 28 extending along the side edges thereof. The carrier assembly also includes a pair of spaced, vertical hinge members 30 and 32 connected at their upper ends to the transfer plate by means of hinge pins 34 and 36 extending between flanges 26 and 28, and connected at their lower ends to the stationary portion of the stop control by means of hinge pins 38 and 40 extending between a pair of vertical mounting plates 42 and 44.

The mounting plates 42 and 44 are thin, flat, rigid panels which may be constructed out of any suitable material to form a rigid housing, or frame, for the stop control 10. In one embodiment, the walls may be printed circuit boards, with one wall, for example panel 42, carrying a printed circuit (not shown) by which control signals are supplied to the stop control device. The mounting plates, or frame members, 42 and 44 are held in spaced relationship by spacer bars such as bar 46 having an enlarged central shank portion between the panels and reduced threaded ends which extend through the panels and are secured thereto by suitable nuts, whereby the shank portion maintains the panels at the proper spacing. The plates 42 and 44 are secured to a frame assembly plate 48 by means of threaded shafts, to be described.

Mounted between the mounting plates 42 and 44 is a solenoid 50 having a central iron core 52 surrounded by an annular coil 54, the core extending the full length of the solenoid windings. The solenoid is attached between the mounting plates by means of end brackets 56 and 58 which are secured to the interior surfaces of plates 42 and 44. Lead wires (not shown) extend from the solenoid coil 54 through the mounting plate 42 and are connected to the printed circuits carried on the surface thereof (not shown) or are connected in any other suitable manner to a selectable source of electrical current for the coil. A suitable terminal block 64 is mounted at the end of mounting plate 42. The terminal block may include a plurality of terminals 66 for connection to external control circuitry.

The end brackets 56 and 58 provide further spacing for the mounting plates and assist in providing a rigid housing for receiving the movable carrier mechanism.

If desired, a single solenoid coil 54 may be provided, with suitable switching circuitry being provided to control the direction of current flow in the coil. In the preferred form of the invention, the solenoid 50 is provided with two annular coils forming a bifilar winding extending the length of the solenoid. Each coil is connectable to a current source of different polarity, so the current flow in the solenoid can be reversed simply by selecting one or the other of the coils.

Hinge member 30 includes an elongated, angled leg portion 70 which incorporates, at its upper end the hinge pin 34, and, at its lower end hinge pin 38. These pins are in the form of pivot shafts which are mounted in corresponding bearings 72 and 74 mounted in the flange 26 of the transfer plate 24 and in the wall panel 42, on one side, and in bearings 72' and 74' mounted in the flange 28 and in panel 44 on the other side. Mounted on the central portion of hinge leg 70 is a permanent magnet 76. Magnet 76 is so mounted on leg 70 as to be in substantial alignment with the iron core 52 of the solenoid 50 when the leg portion 70 is substantially vertical. as shown in FIG. 1, in which position the permanent magnet 76 is closely adjacent the solenoid core.

In similar manner, the hinge member 32 includes an elongated angled leg portion 80 which includes at its upper end the hinge pin 36 and at its lower end the hinge pin 40. These pins are mounted in bearings 82, 82' in the flanges 26 and 28 of the transfer plate and in bearings 84, 84' in the panels 42 and 44. A permanent magnet 86 is mounted on the central portion of hinge leg 80 so that it is in substantial alignment with the iron core 52 when the hinge member 32 is in a substantially vertical position, in which position the permanent magnet 86 is closely adjacent the solenoid core. Like poles of permanent magnets 76 and 86 face the solenoid core.

Resilient pads may be positioned on the inner ends of the magnets 76 and 86, respectively, if desired, to prevent the magnets from striking the end pieces 56 and 58 or the ends of the core 52.

The hinge members 30 and 32 allow the carrier mechanism 18, and thus the transfer plate 24, to move in a generally horizontal plane with respect to the frame defined by mounting plates 42 and 44. The transfer plate shifts between an "out" position illustrated in FIG. 1 where the hinge members are pivoted clockwise as viewed in FIG. 1, and an "in" position (not shown) wherein the hinge members 30 and 32 are pivoted in a counterclockwise direction about pins 38 and 40 from the position illustrated in FIG. 1. This pivotal motion moves magnet 86 toward solenoid 50 and moves magnet 76 away from solenoid 50 as the carrier mechanism 18 shifts.

Motion of the transfer plate between the in and out positions is at first resisted, and then assisted by a pair of permanent magnets, one of which is mounted on the carrier mechanism 18 for motion therewith, and the other of which is mounted adjacent the path of the first, but is fixedly secured to the mounting plate 42. This is illustrated in FIGS. 1 and 2 by a first permanent magnet 100 (not shown in FIG. 1) mounted on transfer plate 24 and a second permanent magnet 102 secured by means of bracket 104 to the mounting plate 42, and visible through aperture 105 in carrier 18. The bracket 104 extends over solenoid 50 so that magnet 102 is mounted adjacent the path of magnet 100 as the carrier mechanism is moved between its "in" and "out" positions. The polarities of the magnets 100 and 102 are oriented so that these magnets repel each other and tend to hold the armature at its "in" or "out" position, thereby enhancing the toggle action.

Mounted on the magnet 102 are resilient pads 106 and 108, preferably of felt, against which a pair of limit posts, or cams, 110 and 112 alternately abut to limit the horizontal motion of the carrier mechanism 18. Posts 110 and 112 are both mounted on transfer plate 24 by means of machine screws 114 and 116, for example, which are off-center to allow adjustment, and are spaced apart sufficiently to permit the desired motion of the armature when they are engaged by the ends of pads 106 or 108, respectively.

A normally-closed reed-type electrical switch 118 is mounted on the panel 42 in a position so it will close when the carrier mechanism 18 moves to the right, as viewed in FIG. 1. This switch is held in place by lugs soldered to the printed circuit on panel 42 for connection to external stop control circuitry (not shown).

The stop control mechanism 10 may be fastened to the rear surface of a jamb 120 of an organ console or like instrument. The jamb 120 includes one or more apertures such as the aperture 122 through which the shaft 14 of the drawknob extends for actuation by an organist. The stop control assembly 10 is secured to the back surface of the jamb by means of, for example, a pair of angle brackets 124 and 126 which are secured, as by means of rivets 128 or other suitable fasteners, to the mounting plates, or frame members, 42 and 44, respectively. The angle brackets are shaped to contact the back surface of the frame assembly plate 48, which is held on jamb 120 by means of wood screws or like fasteners. The stop control is held in place by elongated fasteners 130 and 132 which extend substantially the entire length of the stop control 10, as illustrated in FIG. 3. Each fastener 130 and 132 includes a threaded end, illustrated at 132' for fastener 132, which passes through an aperture in its corresponding angle bracket 124, 126, to engage a threaded aperture in the assembly plate 48, and include a flattened portion 132" at the other end to facilitate turning the fastener. The elongated fasteners include shaft portions which extend through support brackets 134 on the mounting plates 42 and 44 to approximately the end of the mounting plates opposite to their connection with the jamb to allow the stop control 10 to be secured to the back of the jamb 120 even when access to the angle brackets 124, 126 is restricted. This allows easy installation of a stop control in a crowded organ console environment and facilitates installation, removal, and repair of the control.

From the foregoing it will be seen that when the stop control 10 is mounted on a jamb with the shaft 14 extending therethrough, the drawknob may be moved inwardly and outwardly relative to the jamb to cause the carrier mechanism 18 to move in a generally horizontal plane. As illustrated in FIG. 1, the carrier mechanism pivots on hinge members 30 and 32 which are pivotally connecced at their lower ends between stationary panels 42 and 44. The weight of the permanent magnets mounted on the hinge members, together with the weight of the carrier mechanism 18, tends to hold the carrier mechanism in either its leftmost or rightmost position, as viewed in FIG. 1, and prevents free motion. In addition, the permanent magnets interact with the iron core of the solenoid to hold the mechanism 18 at one of its two extremes of motion, so the drawknob is either in the "in" position or in the "out" position.

In the position shown in FIG. 1, the drawknob is in the "out" position and is held there by the interaction of permanent magnet 76 with the iron core 52. If sufficient inward force is applied to drawknob 12, the magnetic attraction between permanent magnet 86 and iron core 52 will be overcome, and the drawknob will move toward the "in" position. As the drawknob moves toward the "in" position, or toward the left as viewed in FIG. 1, the permanent magnet 86 will approach the iron core 52, and at some point the attraction between permanent magnet 86 and the iron core will exceed the attraction between permanent magnet 76 and the iron core, and the carrier mechanism 18 will shift to the "in" position and will be held there. A similar action occurs when the drawknob is moved to the "out" position. This interaction of the magnets and core give the stop control mechanism 10 a "toggle" feel, for it is hard to start shifting the drawknob, but once it is started, it will quickly move to the opposite position. The resilient pads 106 and 108 cushion the shock produced by such a toggle action and prevent the permanent magnets from striking the ends of the solenoid to insure that the control stop will operate in a substantially noise-free manner. In addition, the magnets 100 and 102 pass by each other during the inward and outward motion of the armature and reinforce the toggle action.

In the operation of pushing the drawknob 12 in and turning off the stop, there is virtually no friction because of the hinge pin and bearing system, and because the round shank 14 of the drawknob 12 passes through the oversize hole 122 in the stop jamb 120 and mounting plate 48. It should here be noted that, while such an action will effectively turn off the stop controlled by drawknob 12 and a subsequent action on the part of the organist pulling out the drawknob 12 will again turn the stop on, such arrangement is not the only desirable feature of the invention from the standpoint of the organist, for the stop control 10 also provides a positive "on" and "off" feel as well as the illusion of moving a mass in the operation of a drawknob. In this embodiment of the invention such feel is the product of several forces acting together.

It will be observed that, in the horizontal motion of the carrier mechanism 18, there is also an up and down motion due to the fact that the hinge legs 70 and 80 are pivotally mounted. Accordingly, in pushing the drawknob in or pulling the drawknob out, the organist must first apply sufficient force to raise the mass of the carrier mechanism 18 and its appurtenances, then after the hinge legs pass the center position of their arc of travel, the mass of the carrier mechanism 18 and its appurtenances will cause a downward force adding to the horizontal force applied by the organist. In other words, the force of gravity will exert a negative force on the start of the movement and a positive force at the finish of the movement. The amount of the movement of the drawknob 12 in either direction can be limited by the adjustment of cams 110 and 112.

The toggle feel and illusion of a moving mass is further enhanced by the interaction of the magnetic field of permanent magnet 102, which is attached to the stationary panel 42, with the magnetic field of permanent magnet 100 which is attached to the movable carrier mechanism 18. These two magnets are installed in the assembly so that the two sides closest to each have the same polarity, and will mutually repel each other. The result is to hold the carrier mechanism 18 in the position shown in FIG. 1 (for example) and to resist any change. If, however, sufficient force to overcome the magnet forces is applied to drawknob 12, pushing it toward the stop jamb 120 until permanent magnet 100 is to the left of permanent magnet 102, then the mutually repelling forces of these permanent magnets will add to the force applied to the drawknob. The result of this will be to enhance the toggle feel of the drawknob.

The permanent magnets 76 and 86 also operate to enhance the toggle feel of the drawknob, in conjunction with the iron core 52 of the solenoid 50. In the position shown in FIG. 1, when no current is flowing through the solenoid 50, the action of the magnetic forces of permanent magnet 76 on the iron core 52 of the solenoid draws hinge leg 70 to the right, thereby holding the carrier assembly 18 in the position shown in FIG. 1. When sufficient force is applied on drawknob 12 to push it toward the stop jamb 120, permanent magnet 76 will move away from iron core 52 and the attractive forces will lessen until a point is reached where permanent magnet 86 induces a magnetic field in iron core 52 and draws hinge leg 80 toward iron core 52. From this it will be seen that drawknob 12 is held both in the "on" and "off" positions by the interaction of the magnetic fields of permanent magnets 100, 102, 76 and 86, and that this interaction also provides a very positive toggle action when the drawknob 12 is operated in the manual mode. It will also be observed that because of the interaction of the magnetic forces of the permanent magnets, it is impossible for drawknob 12 to stop in a position which is halfway between the "on" and "off" positions. This interaction of the magnetic forces just described, working together with the force of gravity as employed in the invention, provides the organist with a most desirable toggle action not available in conventional units.

In addition to the foregoing manual operation, the control stop 10 may also be operated in a remote mode by means of the solenoid 50. As illustrated in FIG. 1, the permanent magnets 76 and 86 are both arranged with their north poles closest to the corresponding ends of solenoid 50 so the stop control can be shifted by energizing the solenoid to one polarity or the other. With the stop control initially in the position illustrated in FIG. 1, it can be shifted to the left by energizing the solenoid in the correct direction. If the solenoid employs a single winding, an electric direct current is applied to the winding of the solenoid in such a direction as to induce in the iron core 52 a magnetic force which produces a north pole on the left-hand side of the solenoid 50. Alternatively, if two bifilar windings are provided on the solenoid coil, the direct current is applied to that winding which produces the desired polarity. The permanent magnet 76 will then be repelled by the solenoid, while the permanent magnet 86 will be attracted toward the resulting south pole at the opposite end of the solenoid. This shifts the carrier mechanism 18 to the left, as previously described, placing the drawknob in the "in" position. The current to the solenoid can then be discontinued, and the carrier mechanism will remain in the "in" position until a current of reverse polarity is applied to the single solenoid coil, or a current is applied to the other of the two bifilar windings. In that case, the solenoid produces a north pole in the core at the right-hand end of the solenoid 50, as viewed in FIG. 1, to repel permanent magnet 86 and shift the carrier mechanism to the right, i.e. to the "out" position. In this mode, the hinge members 30 and 32 act as armatures, so that the drawknob can be remotely controlled by the application of currents of selected directions to a single-coil solenoid, or by the application of current to a selected one of two coils on a bifilar solenoid. Preferably, the current is in the form of a short pulse of sufficient amplitude and duration to insure a positive action of the stop control.

As noted with respect to the manual operation of the drawknob, when shifting the drawknob to the "off" position in the electrically controlled mode, the solenoid is energized to attract permanent magnet 86 and to repel magnet 76, and the carrier mechanism 18 starts to shift to the left as viewed in FIG. 1. After a position is reached where drawknob 12 is halfway between the "on" and "off" positions, the forces of gravity and magnets 100 and 102 will further assist in moving drawknob 12 to the desired position, and movement will continue until cam 112 contacts pad 108. Any tendency of the drawknob to rebound or oscillate will be damped because of the powerful magnetic attraction of the permanent magnet 86 to the solenoid 50 with its iron core 52. When the electrical current is interrupted, the forces of gravity, mutual repulsion of permanent magnets 100 and 102, and attraction between permanent magnet 86 and the iron core 52 of solenoid 50 will hold drawknob 12 in the off position.

To electrically move drawknob 12 to the on position, a pulse of electric current, having a polarity opposite of that just described, is applied to solenoid 50. This will cause permanent magnet 86 to be repelled to the right and permanent magnet 76 to be attracted to the solenoid 50, also moving it to the right. After the mid-point has been passed, gravity and the mutual repulsion of permanent magnets 100 and 102 will provide a positive force to move the drawknob 12 to the on position. Such movement will stop when the adjustable cam 110 attached to the carrier mechanism 18 contacts pad 106.

Because of the fact that drawknob assemblies are often located in limited spaces, their installation as well as replacement has been extremely difficult. This invention, however, makes such installation and replacement a relatively simple matter, through the provision of shafts 130 and 132, illustrated in FIGS. 2 and 3. As there shown, bracket 126 at the right-hand end of panel 44 includes a flange which extends out at a right angle to the surface of panel 44 so that it is parallel with frame assembly plate 48. A similar flange extends out from bracket 124 on panel 42 on the side opposite that shown in FIG. 3.

The threaded portion 132' of shaft 132 passes through a hole drilled in the flange of bracket 126 and is screwed into a threaded hole in frame assembly 48, as explained above. The main portion of shaft 132, being larger in diameter than the threaded portion 132', will contact the flange in the manner of the head of a machine screw. The main body of shaft 132 passes through clamps 134 which are fastened to the side of panel 44, the clamps securing the threaded shaft to the side of the panel, but permitting its rotation. The shaft 130 is similar to shaft 132 and attaches the flange of bracket 124 to frame assembly plate 48. The process of installation or replacement of drawknob units is greatly simplified through the use of the aforementioned elements of the invention. The frame assembly plate 48 is first mounted on the back surface of jamb 120 by flat head wood screws (not shown) whose heads are recessed in counter-bored holes in the frame assembly plate. This can easily be done with accuracy since a large hole is provided in the mounting plate 48 which is the same diameter as the hole 122 in the stop jamb 120. Ordinarily, the frame assembly plates for adjacent stop controls will be mounted side by side on the stop jamb with little space between plates. After the frame assembly plates are securely mounted, each drawknob assembly is attached to its frame assembly plate by placing the flanges of the frame mounting brackets against the plate and turning the flattened ends of the threaded shafts 130 and 132 until they hold the flanges tightly against the plate 48. Optional guide pins (not shown) may be used to hold the flanges in position during the process.

The threaded shafts 130 and 132 may first be turned with the fingers and later with a wrench to secure maximum tightness. Since the flattened ends of the threaded shafts will be at the outer end of the drawknob assemblies, they will be readily accessible and because the threaded shafts are secured to the side panels, or frame members, of the drawknob assemblies, there is no danger that they can be accidentally dropped during the mounting process. Accordingly, there is no necessity of trying to work in the narrow spaces between drawknob assemblies.

This invention affords a convenience to the installer not available in conventional drawknob assemblies that have a mounting plate securely attached to their framework. In such units the installer must mount the entire assembly to the stop jamb with wood screws, working in extremely limited space thereby exposing the units to possible damage during installation and making their installation, and especially replacement, extremely difficult. The compact design afforded by the invention and its method of attachment to the stop jamb virtually eliminates any such danger of damage in installation as well as the other well-known difficulties experienced in the installation or replacement of conventional units.

Figure 4:
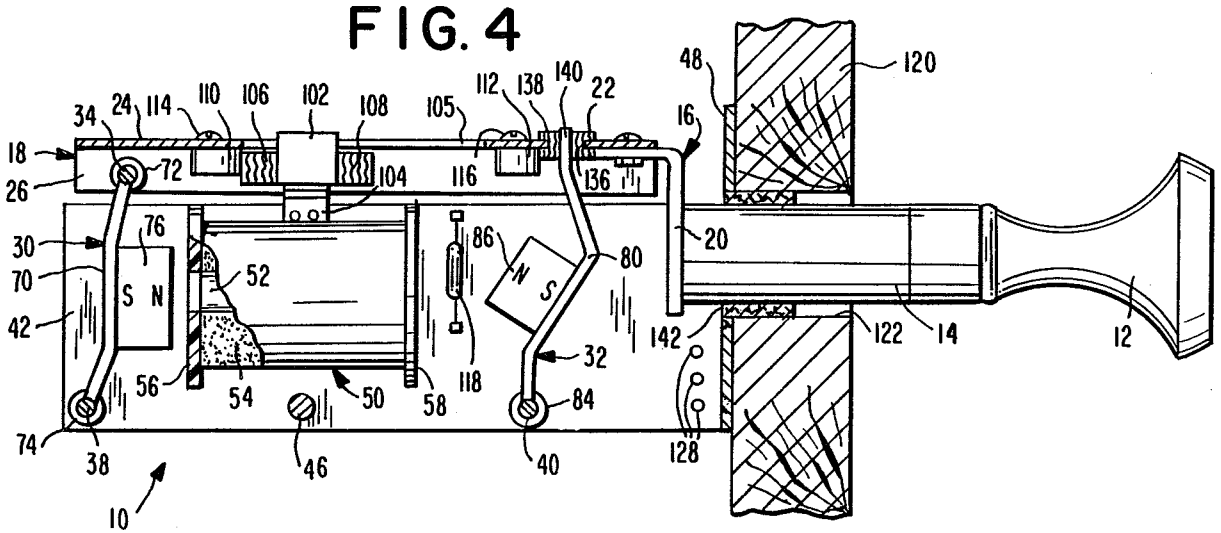
FIG. 4 is a sectional view, taken along line 4—4 of FIG. 5, of a modified version of the stop control of FIG. 1.
Figure 5:
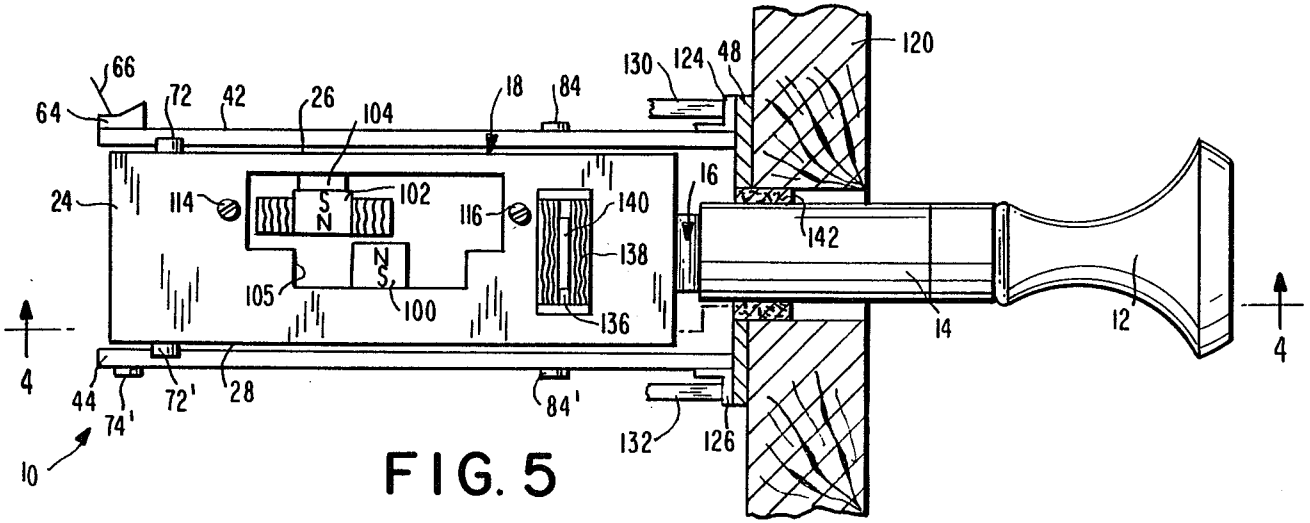
FIG. 5 is a top plan view, in partial section, of the device of FIG. 4.

Another embodiment of the invention, shown by way of example in FIGS. 4 and 5, is an assembly having many of the same elements as the embodiment previously described and shown in FIGS. 1 and 2, and similar elements are similarly numbered.

In this embodiment, FIG. 4 is a sectional side view of the invention and FIG. 5 a top view looking down on carrier mechanism, or assembly, 18. This carrier assembly 18 is similar to that of FIG. 1 except hinge pin 36 and bearings 82, 82' have been removed, a rectangular slot 136 has been cut into transfer plate 24, and a bushing 138 made of felt, nylon or other suitable material, has been inserted into the slot. The upper end 140 of hinge leg, or armature, 80 extends through bushing 138. Armature 80, shown in FIGS. 4 and 5, is of the same construction as that shown in FIG. 1 except that it is longer, bent slightly differently at the top portion, and lacks a top hinge pin. Because of the fact that armature 80 extends through bushing 138, it provides no support for carrier assembly 18.

In order to provide the required support for the front end of carrier assembly 18, an annular bushing 142 made of felt or other suitable material is inserted into the round hole 122 cut through the wooden jamb 120 and the metal frame assembly plate 48. The drawknob shaft 14 can freely pass through the jamb with minimal friction, yet the bushing provides the needed support for the carrier assembly 18.

The modes of operation of this embodiment are similar to that of the embodiment of FIGS. 1 and 2, except that the carrier assembly 18 is not lifted by hinge leg 80 during horizontal motion of the drawknob. Instead, the armature, or hinge leg, 80 passes vertically through the carrier slot 136. Of course, the pivotal motion of leg 80 is transferred to the carrier to provide the required horizontal forces. The addition of the slight amount of friction which is produced between the shank 14 of drawknob 12 and bushing 142, will, when the drawknob 12 is operated in the manual mode, provide a slight damping of the toggle effect of the system, thereby providing a feel to the organist which is different from that of the embodiment of the invention described with respect to FIGS. 1 and 2. Such damping will also occur in the remote electrically operated mode.

If desired, a piece of Teflon or other friction-reducing material may be placed on the surface of felt bushing 142 to reduce the friction between the bushing and the drawknob shaft 14. The damping provided by felt is not constant, since the static friction it provides is different than the sliding friction, and a small piece of low-friction tape between the bottom of shaft 14 and the adjacent bushing surface overcomes this problem.

In the embodiment of the invention described in FIGS. 1–5, the system of hinge members attached to hinge pins that operate in bearings secured to very rigid housing panels results in a mechanism that eliminates the free play associated with conventional systems. Such free play is frequently the source of noise, and its elimination is an important element of the invention. For example, because of the geometry of a conventional organ console, organists seldom pull stops out without exerting a side force on the drawknob; this is usually the case when they pull more than one drawknob at a time. The elimination of side play in the invention by the use of hinge pins and side bearings greatly reduces the noise and friction ordinarily associated with the side play produced in conventional systems. It will further be observed that in the invention it is not possible to rotate the drawknob.

Figure 6:
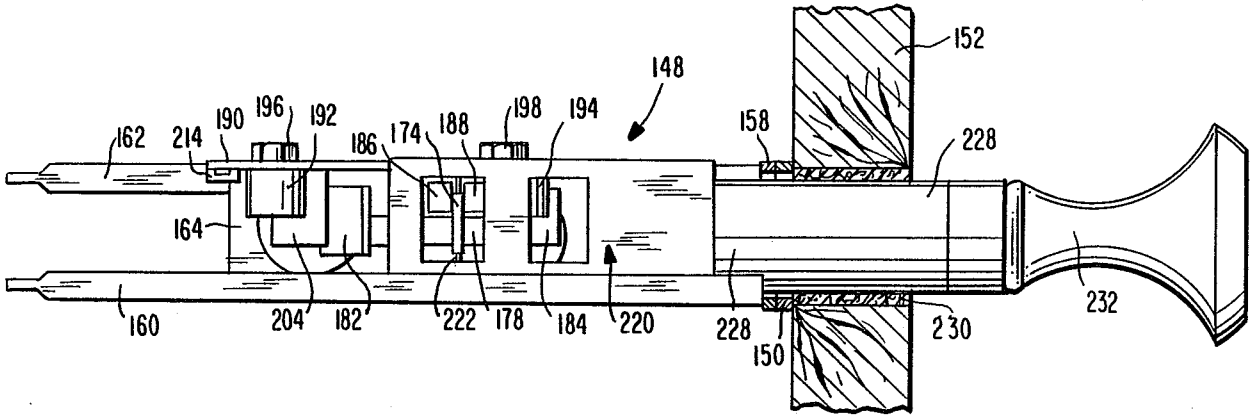
FIG. 6 is a top plan view of a third embodiment of the drawknob stop control in accordance with the present invention.
Figure 7:
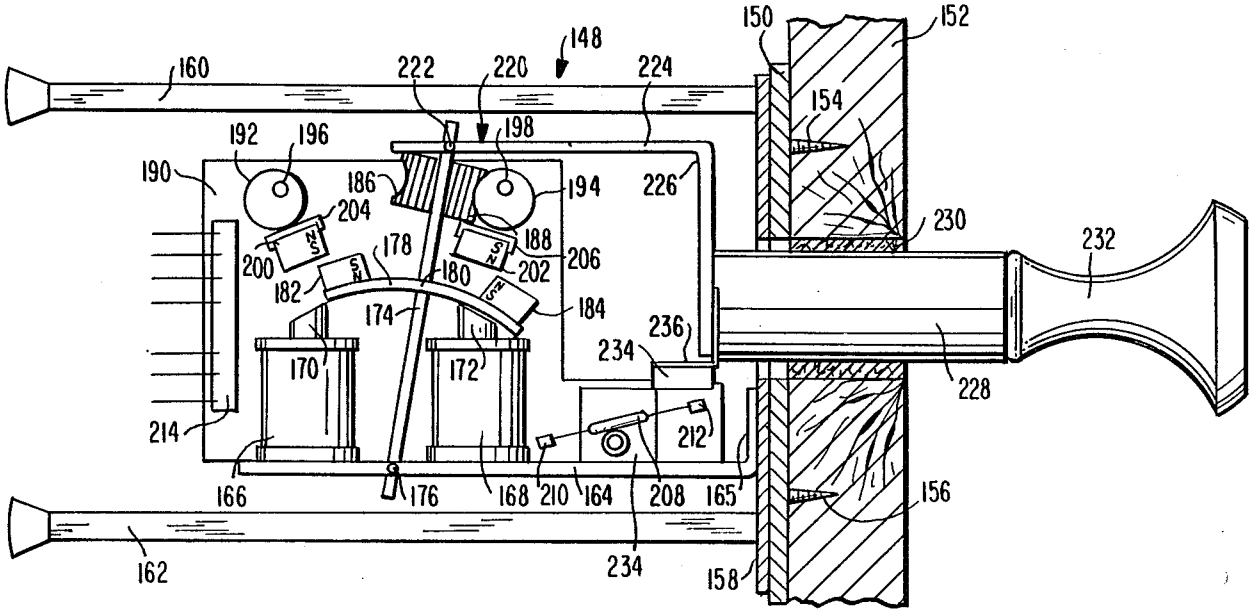
FIG. 7 is a side elevation view of the embodiment of FIG. 6.

FIGS. 6 and 7 illustrate top and side views, respectively, of a modified control stop 148 for an organ drawknob. It will be understood that the control stop can be mounted diagonally, vertically or horizontally in the organ, as by means of a rectangular metal mounting plate 150 secured to the back surface of a stop jamb 152, by means of mounting screws 154 and 156 illustrated in FIG. 7. In the figures, only the jamb 152 and the bearing sleeve mounted in the jamb (to be described) are shown in cross-section.

An assembly frame member 158 is attached to the faceplate 150 by means of mounting shafts 160 and 162, each of which is threaded at one end and flattened at the other end, the threaded ends acting as machine screws which securely attach the assembly frame member 158 to the faceplate 150. The flattened ends of shafts 160 and 162 provide a gripping surface for the shafts to permit assembly and disassembly of the control stop, in the manner described above with respect to FIG. 3.

A main frame member 164 is formed with an upwardly turned flange 165 on its right-hand end, as viewed in FIG. 7 by which the frame member is attached to the assembly frame member 158. The attachment may be by welding, machine screws, or the like to provide a rigid right-angle attachment to the assembly frame member 158.

Mounted to the frame member 164 are a pair of electric solenoids 166 and 168 which have iron cores 170 and 172, respectively. Preferably, the lower ends of the cores have reduced portions which extend through apertures in frame member 164 and are expanded to stake the solenoids firmly on the frame. A hinge arm, or armature 174 is pivotally mounted to the frame 164 by means of a pivot pin 176, and is located between the solenoid 166 and 168. The armature is of a ferromagnetic material and extends generally vertically upwardly, as viewed in FIG. 7, from the frame 164. Midway along the length of the elongated armature is an arcuate cross-member which is generally perpendicular to the axis of the armature 174 and which is rigidly attached to the armature, as by welding. The radius of curvature of the arcuate cross-member is equal to the distance between the pivot point 176 and the point on the armature at which the cross-member is connected, indicated at 180 in FIG. 7. Thus, as the armature pivots about point 176, the cross-member 178 follows the path of connection point 180. The arcuate member 178 preferably is of ferromagnetic material, but may be non-ferromagnetic if desired.

Securely attached to the arcuate cross-member 178 are two permanent magnets 182 and 184.

Attached to the top end of the armature 174, as viewed in FIG. 7, are a pair of resilient pads 186 and 188, which may be of felt or other suitable material.

A printed circuit board 190 is rigidly attached to the frame member 164 by means of lugs on the solenoids 166 and 168 and/or by other suitable means such as soldering. The printed circuit board extends vertically from the member 164 and includes the necessary circuitry for interconnecting the various electrical components of the control stop. The circuit board 190 also carries a pair of limit posts 192 and 194 which are securely attached thereto by machine screws 196 and 198, respectively. The machine screws are offset from the centers of the posts 192 and 194, as best illustrated in FIG. 7, so that the posts act as cams, and can be adjusted by rotation of the mounting screws. The posts 192 and 194 are aligned with the resilient pads 186 and 188, respectively, so as to limit the motion of armature 174 as it moves back and forth between the solenoids 166 and 168 in a path parallel to the circuit board 190.

The circuit board 190 also carries third and fourth permanent magnets 200 and 202 which are similar to magnets 182 and 184 and which are firmly attached to the printed circuit board by suitable clips 204 and 206, respectively. The permanent magnets are located adjacent the path followed by magnets 182 and 184 during motion of the armature 174, and have their polarities as indicated, so that the south pole of magnet 200 faces the south pole of magnet 182, and the north pole of magnet 202 faces the north pole of magnet 184. The two sets of magnets thus repel each other and produce the desired toggle action in the motion of the armature. The printed circuit board also carries a reed switch 208 which is mounted on a pair of standoffs 210 and 212 which are soldered to appropriate circuit lines of the printed circuit board 190. The reed switch is normally closed and is adapted to be connected through the printed circuit board to suitable external circuitry to be controlled. The leads on the circuit board are also connected to the coils for solenoids 166 and 168, with the various leads being connectable to exterior circuitry by way of a suitable connector 214.

A rigid L-shaped transfer plate 220 is connected to the top end of armature 174 by means of a pivot pin 222. The transfer plate 220 includes a horizontal leg 224 and a vertical leg 226, the horizontal leg extending from the armature 174 toward the assembly frame member 158, while leg 226 extends vertically downwardly from leg 224 adjacent assembly frame member 158. The leg 226 is connected to a cylindrical shaft 228 which projects through an annular felt bearing sleeve, or bushing, 230 mounted in an aperture formed in jamb 152. The inner end of shaft 228 is secured to arm 226, while the outer end is secured to a drawknob 232 of the type conventionally used in organ stop controls for manual operation of the armature through carrier 220. The transfer plate 220 and the armature 174 form a carrier assembly for the control stop.

A permanent magnet 234 is secured to a metal angle bracket 236 which, in turn, is connected to the leg portion 226 of transfer plate 220. The bracket 236 secures the permanent magnet in position adjacent the reed switch 208 so that motion of the drawknob inwardly and outwardly will cause the reed switch to move between its closed and open positions.

FIGS. 6 and 7 illustrate the drawknob 232 in its outermost, or "on" position. In this position, the magnet pairs 182, 200 and 184, 202 repel each other and exert a force on armature 174 which tends to rotate it clockwise, as viewed in FIG. 7, about the pivot point 176. This holds the transfer plate 220 and the drawknob 232 in its "on" condition, with the felt pad 188 resting against the limit posts 194. It will be observed that the limits of clockwise rotation of the armature 174 can be varied by adjustment of the cam-shaped limit post 194. In this configuration, the permanent magnet 234 is away from the reed switch 208, which will then be in the closed state.

If a mechanical force is exerted on the drawknob 232 so as to push it toward the stop jamb 152, this force will meet resistance because of the interaction of magnet pairs 182, 200 and 184, 202. As the drawknob is pressed inwardly against the resistance of the magnets, the transfer plate 220 will pivot the armature 174 in a counterclockwise direction. When the magnet pairs 182, 200 and 184, 202 are vertically aligned, the repelling force between the magnets of these two pairs will stop resisting the inwardly motion of the drawknob, and after passing through a neutral position, will instead exert a counterclockwise force on armature 174 to swing the armature in that direction until pad 186 strikes the limit post 192, thereby drawing the drawknob to its innermost limit. The series of forces which first resist movement and then help the movement of the drawknob provides a "toggle" feel to the operator of the drawknob. Thus, the interaction of the magnet pairs not only holds the drawknob in either the "on" or "off" position, but also provides a valuable positive action which enables the operator to determine that the drawknob has actually shifted into its desired position. It will be noted that when the drawknob has moved toward the stop jamb 152 to its off position, the permanent magnet 234 will open the contacts of reed switch 208.

Solenoids 166 and 168 are employed to move the drawknob 232 electrically so that the control stop 148 can be electrically operated from a remote controller. For this purpose, the solenoid cores 170 and 172 extend out of their respective coils to a position adjacent the path of the cross-member 178. Preferably the outermost ends of the cores are shaped to match the curvature of the cross-member so that the cross-member can move freely past the cores, with a relatively small gap therebetween. With the drawknob in the on position illustrated in FIG. 7, the application of an electric current to the coil of solenoid 166 in a direction to generate a south pole at the top end of iron core 170 will attract the end of the cross-member 178 to shift the armature 174 in a counterclockwis direction until the pad 186 contacts limit posts 192. When the armature 174 is at rest in this counterclockwise position, with no current flowing through the coil of solenoid 166, an electric current applied to the coil solenoid 168 in a direction so as to generate a north pole at the top end of its core 172 will attract the end of the cross-member 178 and rotate it clockwise until its motion is stopped when pad 188 contacts limit post 194. This movement of armature 174 under the control of the solenoids 166 and 168 in turn shifts the transfer plate 220 and moves the drawknob 232 between its on and off positions. The amount of movement of the drawknob can be adjusted by rotating the cam-shaped stop posts 192 and 194.

In order to protect the reed switch 208 from the effects of permanent magnets in adjacent stop controls, an anti-crosstalk shield 234 is mounted on the surface of the printed circuit board between that board and the reed switch 208. The shield is preferably of ferromagnetic material and is secured to the printed circuit board by means of a rivet or other suitable fastener.

The construction illustrated in FIGS. 6 and 7 has numerous advantages over the preceding embodiment described with respect to FIGS. 1–5, since it has only two pivot points, thereby reducing friction in the system and reducing the number of potential noise sources. Furthermore, the illustrated arrangement provides a strong toggle action, since it utilizes two pairs of permanent magnets for this purpose. In addition, the location of the magnets 182 and 184 on the ends of the cross-member 178 provide an improved magnetic circuit so as to increase the sensitivity of the armature to electrical control and to thereby reduce the power requirements of the device. Thus, if the cross-member 178 is ferromagnetic, the permanent magnets 182 and 184 magnetize the tips of the cross-member 178, and this tip polarization reduces the effective magnetic gap between the cores 170 and 172 of the solenoids and the permanent magnets 182 and 184. If the armature is non-ferromagnetic, the device will alsol operate since the permanent magnets will be attracted by the solenoids.

It should be noted that as the armature starts to move in one direction or the other due to operation of one of the solenoids, the magnetized tip of the cross-member travels to a location where it becomes aligned with the corresponding solenoid core. This is a neutral position, where the solenoid core will tend to attract the cross-member downwardly, in a direction parallel to the axis of the core. This does not adversely affect the toggle action, however, since at this time the repelling forces of the permanent magnets and the motion of the armature 174 will tend to carry the armature past the neutral point to the end of its path.

A further embodiment of the invention is illustrated in FIGS. 8 and 9, to which reference is now made. In this embodiment, the stop control assembly is connected to a stop tablet to provide manual operation; electrical operation is provided by solenoids, as previously described. As illustrated in FIG. 8, a stop control assembly 248, which is generally similar to that of FIGS. 6 and 7, includes a pivotally mounted hinge arm, or armature 250 connected to a stop tablet 252. The stop tablet is of a conventional type, having a width of approximately ¾ and a length of approximately 2½ inches. This tablet is secured to the left-hand end of the armature 250, as viewed in FIG. 8, with the armature being pivotally mounted by means of a hinge pin 254 extending across an aperture 256 formed in a frame assembly plate 258. The hinge pin may be secured to the armature 250 by means of a cover plate 260 to provide pivotal motion of the armature about pin 254.

The assembly plate 258 is secured to a mounting plate 262 by means of a pair of mounting shafts 264 and 266, the mounting plate 262 being secured to the rear surface of a stop jamb 268 by means of suitable fasteners such as wood screws 270 and 272. The shafts 264 and 266 permit easy assembly of the control stop to the jamb 268, as previously described with respect to FIG. 3.

A printed circuit board 274 is attached to one side of the assembly plate 258 and forms with the assembly plate a right-angle mounting bracket on which components of the control stop 248 may be mounted. The attachment to assembly plate 258 may be by means of soldering the metal foil of the printed circuit board to the metal mounting bracket, for example. The circuit board is mounted so as to be parallel to the armature 250.

Mounted on the circuit board 274 are a pair of limit posts in the form of cams 276 and 278 secured in place by machine screws 280 and 282, respectively. The machine screws pass through holes drilled through the printed circuit board and are threaded into apertures formed in the cams 276 and 278. It will be noted that the apertures are off center so that the cylindrical limit posts function as cams. These cams 276 and 278 serve to limit the up and down motion of the armature 250, and thus of the stop tablet 252 which is attached to the armature. This is accomplished by means of resilient pads 284 and 286 mounted on the outer end of armature 250 and aligned with the limit posts 276 and 278, respectively. The down motion of the stop tablet 252 is limited by the position of post 276 and the thickness of pad 284, while the upward motion of tablet 252 is similarly limited by the position of post 278 and the thickness of pad 286. The resilient pads preferably are made of felt or other suitable material and may be attached by a suitable adhesive to armature 250. Rotation of the posts 276 and 278 permit adjustment of the limits of motion of armature 250.

A permanent magnet 290 is mounted at the outer, terminal end of armature 250 and serves to control the contacts of a reed switch 292 which is mounted on the printed circuit board 274 adjacent the path of armature, 250. The reed switch contacts are normally closed so that when the stop tablet 252 is in tne position shown in FIG. 8, which is the "on" position, the contacts of the switch will be closed. When the stop tablet 52 is moved to the up, or "off" position, magnet 290 will be moved to a position adjacent the reed switch, causing its contacts to open. Preferably, the reed switch is mounted on the circuit board by means of a pair of standoffs 294 and 296 which are connected to appropriate lines on the printed circuit carried by circuit board 274. A shield 298 is mounted on the face of the circuit board behind the reed switch 292 to prevent interference from adjacent stop control assemblies.

Firmly attached to the printed circuit board 274 are a pair of permanent magnets 300 and 302. These magnets are so located that their sides are tangent to an arc having its radius centered at the hinge pin 254. A complementary pair of permanent magnets 304 and 306 are mounted on an arcuate cross-member 308 secured at its center to the armature 250. The curvature of the cross-member 308 has its radius centered at the hinge pin 254 and the magnets 304 and 306 are mounted thereon so as to have their outwardly facing sides also tangent to an arc having its center at hinge pin 254, with the magnets 300 and 304 having their adjoining faces substantially parallel to each other and the adjoining faces of permanent magnets 302 and 306 similarly being substantially parallel to each other. Permanent magnets 300 and 304 are mounted with like poles facing each other so as to form a toggle pair; similarly, permanent magnets 302 and 306 have like poles facing each other.

As previously described, stop tablet 252 is shown in FIG. 8 as being in the down, or on position. Since like magnetic poles repel, the repelling action of magnets 300, 304 and 302, 306 produce forces on armature 250 by way of cross-member 308 that will tend to move it in a counterclockwise direction. However, since the armature is already in its maximum counterclockwise position, with the resilient pad 284 abutting the limit post 276, the forces of the magnet pairs will retain it in the position shown. When an organist moves the stop tablet 252 from the illustrated position toward the up or "off"

position, the two toggle pairs of permanent magnets 300, 304 and 302, 306 will act to resist its movement until such time as the organist moves the tablet to a position about half way between the on and off positions. At that neutral point there will be no resistance to the movement of the tablet, and then there will be a force provided by the magnet pairs to repel the magnets 304 and 306 in a clockwise direction to carry the armature 250 to a limit position defined by the post 278 and resilient pad 286. This resisting force, followed by a neutral force, followed in turn by an assisting force which carries the armature to the desired position provides a desirable toggle "feel" to the motion of the tablet 252.

Remotely controlled operation of the control stop 248 is provided by means of a pair of electromagnets, or solenoids, 310 and 312 mounted on the mounting plate 258. The solenoids are located on opposite sides of the armature 250 and include iron cores 314 and 316, respectively. The ends of the cores 314 and 316 are curved to match the curvature of cross-member 308, and are located close to the arcuate path of element 308. The solenoids include excitation coils which are connected by way of suitable lugs (not shown) to corresponding lines on the printed circuit board 274. Solenoid 310 is activated to move the armature 250 upwardly, and thus to move tablet 252 downwardly. Similarly, solenoid 312 moves armature 250 downwardly and tablet 252 upwardly.

The solenoids 310 and 312 are firmly attached to both the assembly plate 258 and to the circuit board 274 in order to provide a rigid, secure structure. The connections to plate 258 may be by way of the cores 314 and 316 as explained with respect to FIG. 7, or by way of other fasteners, while the connection to circuit board 274 preferably is by way of electrical connection lugs secured to the solenoid and extending through apertures formed in the circuit board. These lugs are then soldered to corresponding lines on the circuit board to make electrical connection to the coil and to firmly attach the solenoid to the board.

As explained with respect to the embodiment of FIGS. 6 and 7, the permanent magnets 304 and 306 magnetize the tips of the cross-member 308. Assuming that the tablet 252 is in the on position illustrated in FIG. 8, application of a current pulse to the coil of solenoid 312 will produce a polarization in core 316 which will attract the polarized tip of cross-member 308 to thereby draw the armature 250 in a clockwise direction. Conversely, a pulse applied to solenoid 310 will produce a polarization on core 314 which will tend to rotate the armature 250 in a counterclockwise direction, as previously described.

The printed circuit board also carries a connector 320 to which the circuit elements from board 274 are connected and which provide connection points for external circuitry in known manner.

The several embodiments of the invention described above provide quiet, low-friction, toggle action stop controls which have low electrical energy requirements, which do not have side-to-side or rotational play, and which are responsive and reliable in operation. Because of the very low friction in the pivot bearings some users may find the operation to be not sufficiently damped for their taste, and in fact a small amount of "bounce" may be evident when the drawknob or tabs are rapidly operated. In such a case, it is desirable to provide a manually adjustable damper 330 of the type illustrated in FIG. 10.

Damper 330 is shown as being applied to the assembly of FIGS. 6 and 7, although it is equally usable with the other embodiments of the invention. The damper includes a vertical support arm 332 mounted, for example, on frame 164 and extending upwardly adjacent the path of armature 174 and its cross-member 178. The support arm carries a spring leaf 334 on its inner surface adjacent the edge of the arcuate cross-member 178. A friction pad 336 of a material such as tetrafluoroethylene (Teflon) is secured to the face of spring leaf 334 and is pressed into contact with the edge of cross-member 178 by means of a threaded adjustment screw 338 mounted in arm 332. The pressure of the pad 336 is adjusted by turning screw 338, to thereby adjust the distance between leaf 334 and arm 332. In this way, it is possible to precisely adjust the amount of damping. The minimum damping that prevents rebound, or "bounce", is called "critical damping". Many organists find this to yield the most desirable "feel", while others prefer a slightly underdamped condition, which yields a smoother, more positive toggle at the expense of a small amount of bounce. It should be pointed out that prior stop controls, particularly drawknobs, have almost always been greatly overdamped because of the inherent friction in their moving parts, and this overdamping has been eliminated by the present invention.

Although the present invention has been described in terms of preferred embodiments, it will be apparent that variations and modifications may be made without departing from the true spirit and scope thereof, as set forth in the following claims.

What is claimed is:

1. A unitary stop control for musical instruments, comprising a housing;

horizontally movable carrier means pivotally supported on said housing for motion between first and second positions;

solenoid means fixedly mounted on said housing adjacent the path of motion of said carrier means, said solenoid including an iron core;

first and second permanent magnets mounted on said carrier means and movable therewith, said permanent magnets being located at opposite ends of said iron core and spaced therefrom, motion of said carrier means toward said first position causing said first permanent magnet to move toward contact with said iron core to hold said carrier means in said first position, and motion of said carrier means toward said second position causing said second permanent magnet to move toward contact with said iron core to hold said carrier means in said second position and to provide a toggle operation of said carrier means; and a drawknob for manually shifting said carrier means between said first and second positions.

2. The stop control of claim 1, further including means for applying a direct current of selectable polarity to produce selected magnetic poles at the ends of said iron core which interact with said first and second permanent magnets to thereby electrically shift said carrier means between said first and second positions.

3. The stop control of claim 2, wherein said carrier means includes a horizontal transfer plate supported by first and second spaced hinge members, each of said hinge members being connected at one end to said housing and at the opposite end to said transfer plate.

4. The stop control of claim 3, wherein said solenoid is mounted between said first and second hinge members, with said iron core being generally parallel to said transfer plate.

5. The stop control of claim 4, wherein said first and second permanent magnets are mounted on said first and second hinge members, respectively, in general alignment with said iron core.

6. The stop control of claim 5, further including resilient means limiting the motion of said armature.

7. The stop control of claim 5, further including elongated fastener means for securing said housing to a musical instrument stop jamb, said fastener means including shaft means extending substantially the entire length of said stop control.

8. The stop control of claim 5, wherein each said hinge member is connected to said housing by way of a hinge pin, passing through corresponding bearings mounted in said housing, whereby said hinge members are pivotally mounted to said housing.

9. The stop control of claim 8, wherein each said hinge member is connected to said horizontal transfer plate by way of a hinge pin on said hinge member and passing through corresponding bearings mounted in said transfer plate, whereby said hinge members are pivotally mounted to said plate.

10. The stop control of claim 1, further including:

a third permanent magnet, said third magnet being mounted on said transfer plate for motion therewith; and a fourth permanent magnet mounted on said housing adjacent the path of motion of said third permanent magnet to enhance the toggle action of said carrier means.

11. The stop control of claim 1, wherein said carrier means includes a horizontal transfer plate and first and second spaced, generally vertical hinge members, each of said hinge members being mounted at its lower end on said housing for pivotal motion, and the upper end of each of said hinge members engaging said horizontal transfer plate.

12. The stop control of claim 11, wherein said first hinge member is pivotally connected to said horizontal transfer plate and said second hinge member passes through an aperture in said horizontal transfer plate.

13. The stop control of claim 12, further including bushing means in said transfer plate aperture for damping the motion of said transfer plate.

14. The stop control of claim 13, further including bearing means in said housing for pivotally mounting said hinge members to prevent side and rotational play in said transfer plate and drawknob.

15. The stop control of claim 11, further including adjustable damping means for controlling the motion of said carrier means.

16. The stop control of claim 11, wherein said first and second hinge members and said transfer plate form three sides of a parallelogram.

17. A unitary stop control for musical instruments, comprising:

a frame member;

an armature pivotally mounted at one end in said frame member and extending generally perpendicular thereto, said armature having a free end and being movable along an arcuate path;

first and second solenoids mounted on said frame member, one on each side of said armature, each solenoid including a core member;

arcuate cross-member means secured to said armature and including first and second arms extending to corresponding sides of said armature and toward said first and second solenoids, respectively;

permanent magnet toggle means for each of said first and second arms;

resilient pad means located at the free end of said armature;

limit post means at opposite ends of the arcuate path of the free end of said armature and located to engage said resilient pad means to limit the motion of said armature;

reed switch means;

switch magnet means connected to said armature for motion therewith along a path to operate said reed switch; and manual operator means connected to said armature for motion therewith, said armature being movable electrically by said solenoids or manually by said operator means between said limit post means.

18. The stop control of claim 17, wherein each said permanent magnet toggle means includes a pair of permanent magnets having facing surfaces of the same polarities, one of said pair being mounted on said cross-member means for motion therewith, and the other of said pair being fixedly mounted adjacent the path of said first one of said pair, whereby said permanent magnets of each said toggle means repel each other to produce a toggle action.

19. The stop control of claim 18, wherein each of said first and second cross-member arms is magnetized by its corresponding permanent magnet.

20. The stop control of claim 19, wherein said first cross-member arm overlaps said first solenoid when said armature is at one end of its arcuate path, and said second cross-member arm overlaps said second solenoid when said armature is at the other end of its arcuate path, and wherein said solenoid core members cooperate with the polarized tips of said cross-member arms upon energization of said solenoids to shift said armature.

21. The stop control of claim 17, wherein said manual operator means comprises a drawknob connected to the free end of said armature.

22. The stop control of claim 17, wherein said manual operator means comprises a control tablet mounted at said one end said armature.

23. The stop control of claim 17, wherein said cross member means is a ferromagnetic material, whereby said permanent magnets mounted thereon produce tip polarization in said cross-member for enhanced toggle action.

* * * * *